US008328149B2

(12) United States Patent
McLaughlin

(10) Patent No.: US 8,328,149 B2
(45) Date of Patent: Dec. 11, 2012

(54) TOP ACCESS LEVELER ASSEMBLY

(75) Inventor: William McLaughlin, North Palm Beach, FL (US)

(73) Assignee: Stable Tables, LLC, North Palm Beach, FL (US)

( * ) Notice: Subject to any disclaimer, the term of this patent is extended or adjusted under 35 U.S.C. 154(b) by 193 days.

(21) Appl. No.: 12/712,896

(22) Filed: Feb. 25, 2010

(65) Prior Publication Data

US 2011/0203495 A1 Aug. 25, 2011

(51) Int. Cl.
*F16M 11/24* (2006.01)

(52) U.S. Cl. ..... 248/188.4; 248/188.2; 248/188.8

(58) Field of Classification Search ..... 248/688, 248/188.1, 188.2, 188.4, 188.5, 354.3, 649, 248/616, 188.3, 188.8
See application file for complete search history.

(56) References Cited

U.S. PATENT DOCUMENTS

| | | | | |
|---|---|---|---|---|
| 2,844,905 | A * | 7/1958 | Musser et al. | 42/94 |
| 2,921,760 | A * | 1/1960 | Wheeler | 248/615 |
| 3,175,795 | A | 3/1965 | Adams | |
| 3,687,443 | A * | 8/1972 | Anderson | 269/309 |
| 3,868,079 | A | 2/1975 | Johnson | |
| 4,798,359 | A * | 1/1989 | Ball | 248/188.3 |
| 5,042,764 | A | 8/1991 | Carpinella | |
| 5,092,550 | A | 3/1992 | Bettini | |
| 5,141,190 | A * | 8/1992 | Wu | 248/188.4 |
| 5,881,979 | A | 3/1999 | Rozier, Jr. | |
| 5,924,658 | A * | 7/1999 | Shiery et al. | 248/125.8 |
| 6,186,453 | B1 | 2/2001 | Redbone | |
| 6,520,459 | B2 | 2/2003 | Burr | |
| 6,902,140 | B1 * | 6/2005 | Huang | 248/188.4 |
| 6,983,570 | B2 * | 1/2006 | Mead | 52/263 |
| 7,118,081 | B2 * | 10/2006 | Smith et al. | 248/188.2 |
| 7,198,238 | B2 | 4/2007 | Inoue | |
| 7,290,741 | B1 * | 11/2007 | Cox et al. | 248/188.4 |
| 7,588,386 | B2 | 9/2009 | Kielezewski et al. | |
| 7,775,489 | B2 * | 8/2010 | Facis et al. | 248/188.8 |
| 2002/0139908 | A1 | 10/2002 | Oyama et al. | |
| 2006/0186287 | A1 * | 8/2006 | Bender | 248/188.2 |

* cited by examiner

*Primary Examiner* — Bradley Duckworth
(74) *Attorney, Agent, or Firm* — McHale & Slavin, P.A.

(57) ABSTRACT

A top access leveler assembly for leveling a table by use of a pedestal guide barrel, a leveling adjustment screw, and an adjustment driver. The leveling adjustment screw has a lower end with a foot pad and an upper end that can be rotated by the use of an adjustment driver. The adjustment driver is positioned within a cavity of the pedestal guide barrel and is further operated by a knob guide barrel that employs the use of alignment channels to allow the knob guide barrel to be twisted into a position where a spring biases the knob upward to allow ease of rotation. Once the knob is raised, the leveling adjustment screw is accessed from the top wherein the alignment channels allow rotation of the adjustment driver in either a clockwise or counterclockwise direction for use in extending the foot pad beneath the base of the table. The alignment guides further allow for the depressing of the guide barrel into the cavity and with a slight rotation places the guide barrel in a recessed position when not in use. The knob guide barrel includes a knob having an upper surface that is designed to be flush with an upper surface of the pedestal base when not in use and extends above the upper surface of the pedestal base to allow ease of rotation.

17 Claims, 10 Drawing Sheets

TOP ACCESS LEVELER ASSEMBLY

FIELD OF THE INVENTION

The present invention relates to furniture, namely tables and the like that must be level, and more particularly to a top access leveler assembly that allows for ease of furniture leveling by rotation of a control knob located above a foot bolt.

BACKGROUND OF THE INVENTION

A piece of furniture that is not level can be very annoying. The moment that there is any weight on one side of the furniture, such as a table, the other side moves up and vise versa. This makes for an uncomfortable platform to work on or eat from. The consuming public is well aware of the difficulty in sitting at a table that wobbles. This is especially noticeable at restaurants where tables receive a high level of use. The wobbling table may also be due to uneven floors, table age, shrinkage of wood, bending of metal, and so forth.

The legs or pedestals of many tables are provided with glides which are typically mounted by screw threads to enable the glides to be vertically adjusted for stable support of the table on floor surfaces which are not perfectly level. The difficulty with conventional table glides is that it is a time consuming process to properly adjust them. In a busy restaurant setting, time is simply not available to make such adjustments each time a table is moved. Such adjustments would likely require that the table be tipped up or turned down on its side for access to the glide with a tool if necessary. Accordingly, such adjustments may be an unacceptable disruption in any event. Finally, even if the table glides are properly adjusted once, readjustment would be necessary each time the table is moved to accommodate combining tables or different table arrangements.

Even on level surfaces, adjustment may be necessary when combining tables to level them relative to one another. When two tables are moved together, they not only need to be stabilized at that new position, but also leveled with one another to eliminate a ledge at the joint since it may be necessary for a patron to be seated at the junction where two tables meet.

In an effort to avoid wobbly tables, restaurants have been known to use cardboard matches or plain wood wedges below selected table glides for leveling and stabilizing wobbly tables. The matchbooks are somewhat compressible and aesthetically detract from what otherwise may be a very elegant restaurant atmosphere. The common wood wedge provides vertical support, but no lateral support. Accordingly, if the table is bumped or moved slightly, it can be moved off of either of these supports. Furthermore, it is difficult to insert a common wedge under the glides of a table pedestal because the precise position of the table glide cannot be seen unless the waiter gets down on hands and knees with his eyes near the floor.

For whatever the reason, a table that wobbles is not only a nuisance but can adversely affect the business owner. For instance, if the table is found at a restaurant, the restaurant could lose customers who are tired of having their drinks spilled. It is not uncommon to find a restaurant customer placing a match book or napkins beneath one of the table legs to be used as a wedge. Obviously, this fix is unsanitary and most unreliable, for the moment the table moves the wedge can be displaced and the table will need to be releveled. Astute customers will have nothing to do with touching the floor of a busy restaurant; and even if a restaurant helper assists, the action is most distracting and the customer is left to wonder if the restaurant helper washed their hands after they worked on the floor.

Prior art levelers for tables typically include a simple metal foot with extending bolts that can be inserted into the bottom of each leg to an adjustable depth. For instance, U.S. Pat. Nos. 3,175,795 and 3,868,079 disclose an adjustable foot bolt that is placed through the bottom of a table or appliance and set at an adjustable level wherein a locknut is then used to secure the foot bolt in position. Unfortunately, this type of adjustment requires working beneath the base of the table and typically requires the use of a wrench for turning of the foot bolt.

U.S. Pat. No. 5,881,979 discloses a telescoping leveler that can be used with furniture. The device has a cylindrical intermediate member threaded on both an outside surface and an inside surface, allowing extension of the conventional foot bolt leveler. This device would require adjustment by grasping the foot pad that engages the floor.

U.S. Pat. No. 7,198,238 discloses a leg support device that allows adjustment of the leg by movement of an operation knob which disengages threads, allowing the adjustment screw to be moved upward or downward and locked in position by release of the operation knob. Such a device can be activated inadvertently thereby causing a table to become unbalanced.

What is lacking in the art is a furniture adjustment device that can be operated without having to work beneath the furniture base.

BRIEF SUMMARY OF THE INVENTION

An adjustable support for use in leveling a table having a pedestal guide barrel formed from a generally cylindrical member with an upper opening and a threaded lower opening, an external side wall and an internal side wall with the external side wall securable to the base of the table in need of leveling. A leveling adjustment screw extends from the base, the leveling adjustment screw has an upper end with a first contact surface such as a hex head, a lower end for securement to a foot pad, and a threaded shaft portion therebetween which is threadably engaged in the threaded bore, such that the threaded shaft portion can be extended from a recessed position to an extended position. An adjustment driver is also positioned within the cavity of the guide barrel. The adjustment driver has a hex shaped engagement bore forming a first receptacle contact surface for slidable receipt of the hex shaped contact surface of the leveling adjustment screw. The outer surface of the adjustment driver forms a second contact surface, which in the preferred embodiment is also hex shaped. A knob guide barrel is finally positioned over the adjustment driver and within the cavity of the pedestal guide barrel, forming a hex shaped second receptacle contact surface along an internal chamber for slidable receipt of the adjustment driver hex shaped second contact surface. The knob guide barrel employs the use of alignment channels to allow the knob guide barrel to be twisted into a position where a spring biases the knob upward to allow ease of rotation. Once the knob is in a raised position, the alignment channels allow rotation of the adjustment driver in either a clockwise or counterclockwise direction for use in extending the foot pad beneath the base of the table. The alignment guides further allow for the depressing of the guide barrel into the cavity and with a slight rotation places the guide barrel in a recessed position when not in use. The knob guide barrel includes a knob having an upper surface that is designed to be flush with an upper surface of the pedestal base when not in use and extends above the upper surface of the pedestal base to allow ease of rotation.

An objective of the instant invention is to provide a top access leveler assembly.

Another objective of the instant invention is to provide an adjustable support that can be concealed when not in use.

Still another objective of the instant invention is to provide an adjustable support that is recessed when it is not in use to prevent accidental movement.

Yet still another objective of the instant invention is to provide an aesthetically pleasing adjustable support for furniture.

Still another objective of the instant invention is to provide an adjustable support that can be operated without hand tools.

Yet still another objective of the instant invention is to provide an adjustable support that can be mounted into the leg of the table and can be accessed by a leveler assembly located on the upper surface of a table support member.

Still another objective of the instant invention is to provide an adjustable support that can be adjusted from the top of a pedestal base so as to eliminate the need for tilting of a table to cause leveling adjustment.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
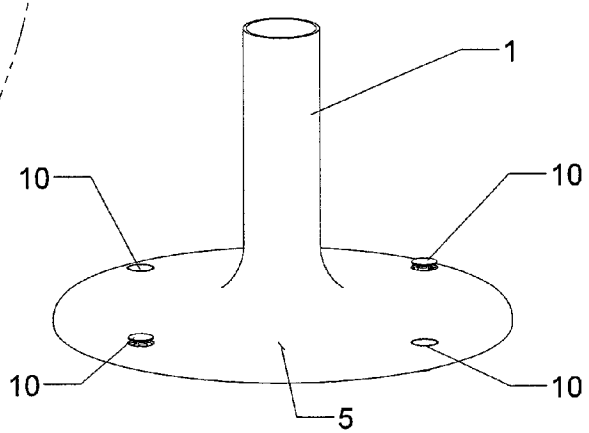
FIG. 1 is a perspective view of a pedestal.
Figure 2:
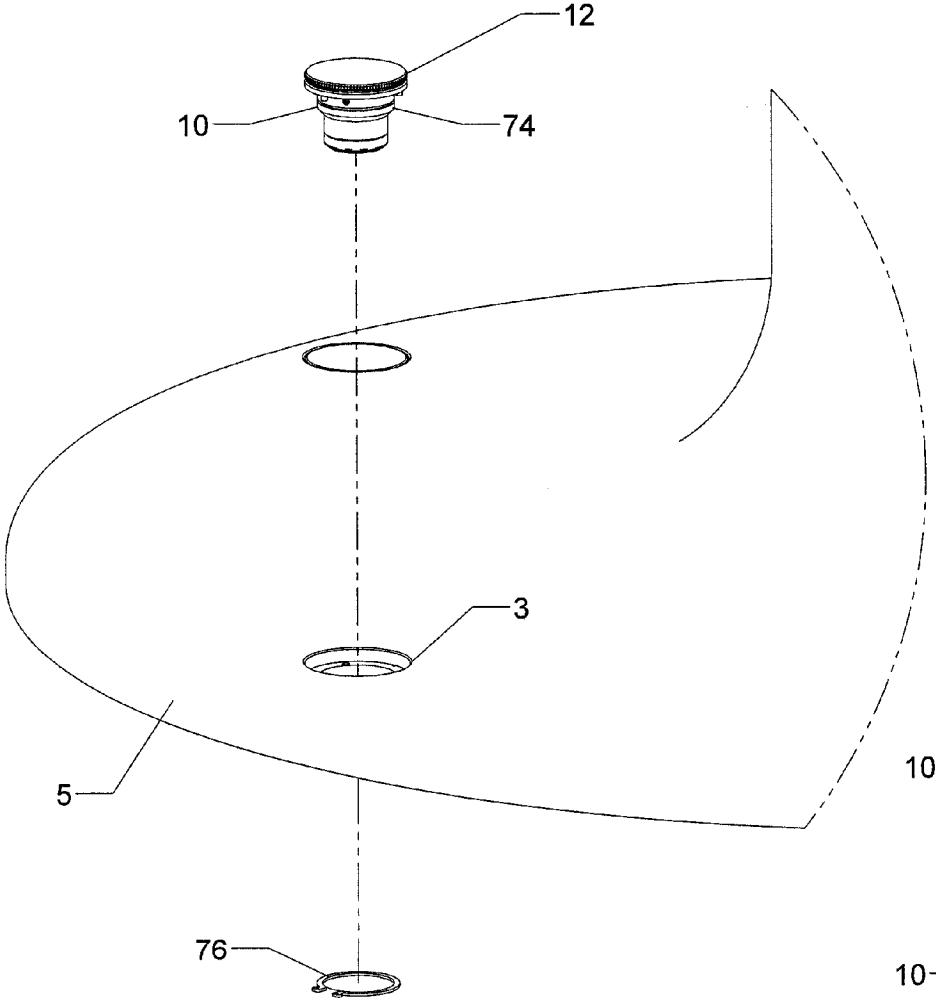
FIG. 2 is an enlarged view of a portion of the pedestal of FIG. 1 with the top access leveler assembly shown available for mounting to the pedestal.

Now referring to the figures in general, and FIGS. 1 and 2 in particular, set forth is a pedestal (1) illustrating the top access leveler assemblies (10) with the guide barrel in a raised position (10') and with the guide barrel in a recessed position (10). The pedestal (1) with the top access leveler assembly (10) available for mounting in the pedestal with a retainer ring (76) available for securing the top access leveler assembly in aperture (3) constructed and arranged to receive the assembly. It should be noted that the pedestal assembly shown is for illustration purposes only and the top access leveler assembly can be placed in any leg wherein a top access is beneficial. The size of the assembly can be changed to accommodate various furniture leg or pedestal thicknesses. The pedestal and assembly are arranged to allow the knob (12) to become flush with the surface (5) of the pedestal (1) for complete concealment of the adjustment mechanism when not in use. This recessed position further prevents accidental movement of the adjustment mechanism and can be made aesthetically pleasing so as to not distract from the ornamental shape of the pedestal base, table legs, foot supports or any other table, chair, or support mechanism that requires adjustment to prevent wobbling.

Figure 3:
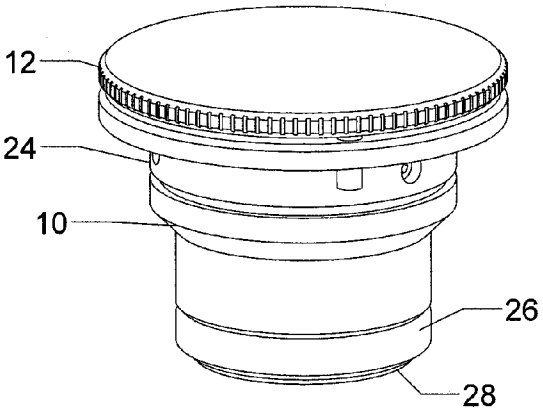
FIG. 3 is a perspective view of the top access leveler assembly.

FIG. 3 depicts a perspective view of the top access leveler assembly (10) having a knob (12) positioned against the pedestal cap (24) with the footpad cap (26) and footpad (28) shown in a recessed position as will be described later in this specification, the knob (12) can be rotated wherein a spring projects the knob in an upward position of the knob guide barrel (14) freeing the knob (12) for rotation to allow deployment or retraction of a leveler adjustment screw (20) for positioning of the footpad cap (26) and footpad (28).

Figure 4:
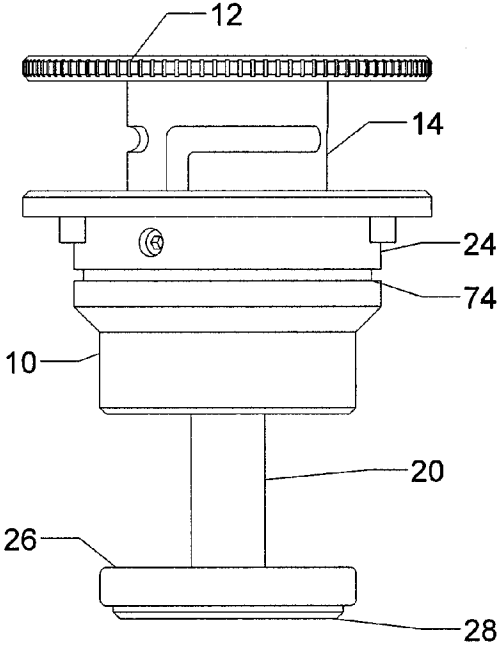
FIG. 4 is a side view of the top access leveler assembly with a knob guide barrel raised allowing extension of the footpad.

FIG. 4 depicts the top access leveler assembly (10) wherein the knob (12) is raised so as to allow rotating of the knob guide barrel to engage the pedestal cap (24) wherein the leveler adjustment screw (20) can be placed in a position that allows leveling of the table that is illustrated with the footpad cap (26) and footpad (28) in a deployed position.

Figure 5:
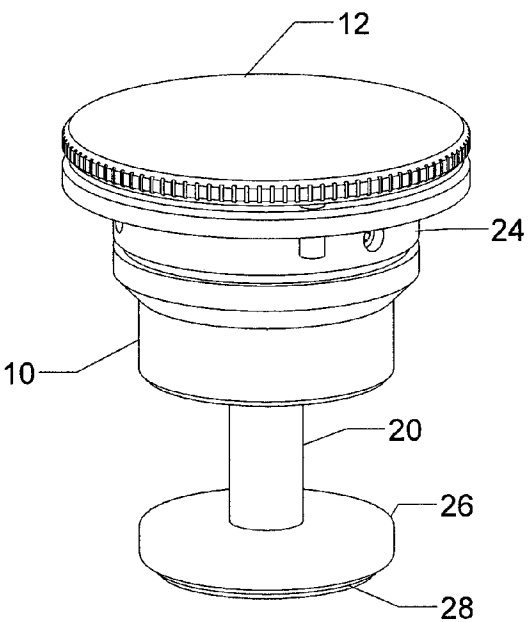
FIG. 5 is a perspective view of the top access leveler assembly with a footpad extending and the knob guide barrel in the recessed position.

FIG. 5 depicts the top access leveler assembly (10) wherein the knob (12) is depressed so as to disengage operation of the knob guide barrel wherein the leveler adjustment screw (20) is no longer operational, the leveling of the table complete with the footpad cap (26) and footpad (28) in a deployed position.

Figure 6:
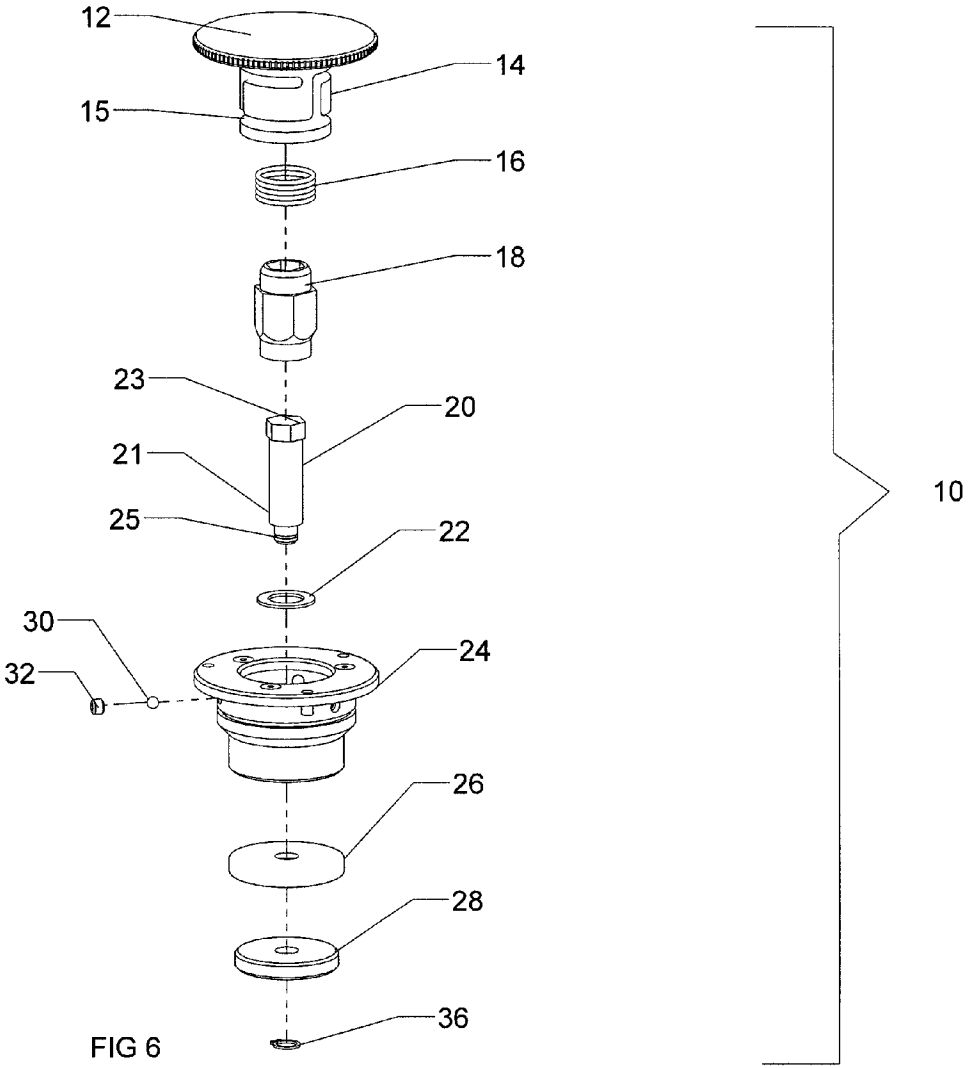
FIG. 6 is an exploded view of the top access leveler assembly.

FIG. 6 is an exploded view of the top access leveler assembly (10) illustrating the knob (12) coupled to the knob guide barrel (14) having alignment channels (15) which are constructed and arranged to cooperate with the pedestal cap (24) for placing the knob in a recessed position to inactivate operation of the level adjustment screw (20); or in a raised position which allows rotation of the leveler adjustment screw (20) from movement of the footpad (28). A compression spring (16) provides a biasing means to raise the knob guide barrel (14) and knob (12) when the channels (15) are aligned with a roller ball (30) to prevent the locking of the guide barrel (14) in a recessed position, or release of the guide barrel into a raised position to allow the knob to be rotated in either a clockwise or counter clockwise position. The knob guide barrel is constructed and arranged to receive the adjustment driver (18) which has a length for receipt of leveler adjustment screw (20). The outer surface or leveler adjustment screw outer surface (21) of the leveler adjustment screw (20) is threaded preferably with a ⅜-16 UNC 2B external thread which provides adequate adjustment for most installations.

The pedestal cap (24) receives the leveler adjustment screw (20), employs a wear resistant washer (22), such as delrin, and operates to allow ease of rotation of the adjustment driver (18) and prevent extension of the leveler adjustment screw (20) hex head (23) from passing through the pedestal cap (24). The leveler adjustment screw (20) has an engagement end (25) that passes through a footpad cap (26) which covers the majority of the footpad (28), for aesthetic purposes only, both of which are held to the leveler adjustment screw by the use of the retainer ring (36). The retainer ring is preferably a snap ring that allows for ease of assembly as well as replacement of the footpad should excess wear of the footpad occur.

Figure 7:
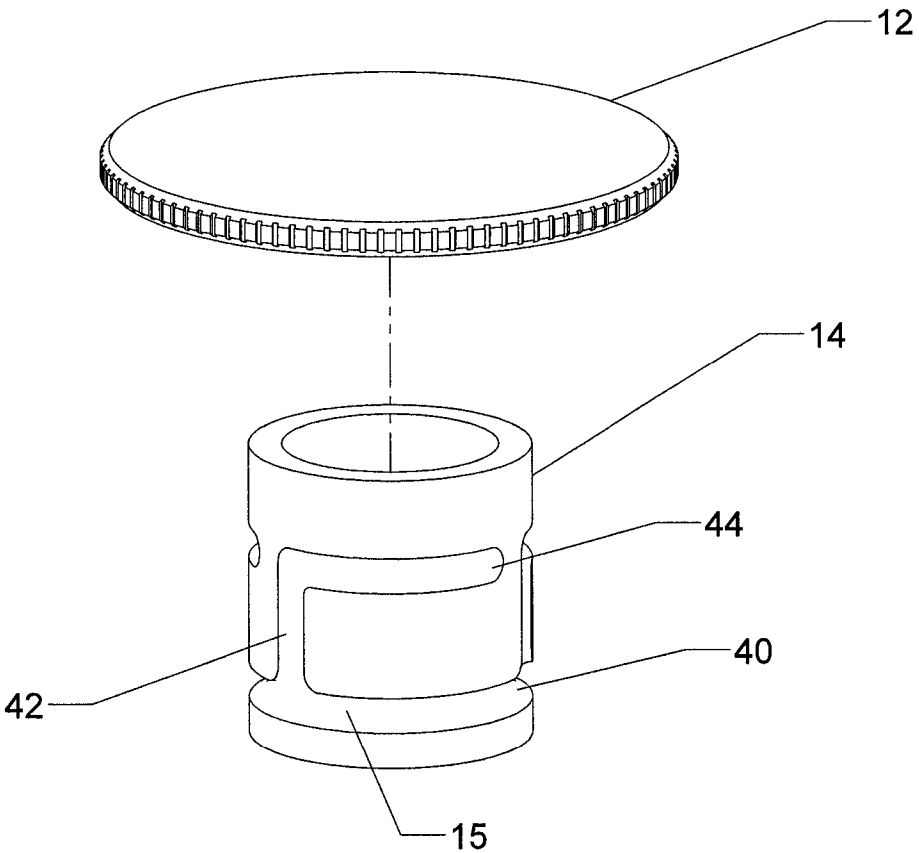
FIG. 7 is an exploded view of the knob guide barrel and knob.

FIG. 7 illustrates the knob (12) separated from the knob guide barrel (14). The alignment channels (15) can be viewed with a bottom channel (40) and encompasses the circumference of the knob guide barrel and allows free rotation of the knob, for engaging of the adjustment driver (18) when the knob is in a raised or deployed position. As previously mentioned, the pedestal cap (24) includes the use of at least one ball (30) which is mounted to the pedestal cap (24) by a set screw (32) and fits within the alignment channels (15). If the ball (30) is placed within the lower channel (40), the knob is in a raised position allowed to rotate in a clockwise or counter clockwise position so as to rotate the adjustment driver causing movement of the leveler adjustment screw in an upward or downward direction for deployment of the footpad. Alignment channel (42) allows the knob guide barrel (14) to be placed into a recessed position wherein the ball (10) rides through channel (42) wherein the knob guide barrel can be raised or lowered where the ball is situated in the channel. Upper channel (44) allows receipt of the ball (30) wherein a partial rotation of the knob (12) effectively positions the ball (30) within the channel (44) wherein the knob guide barrel and knob (12) are effectively stationed in a recessed position.

Figure 8:
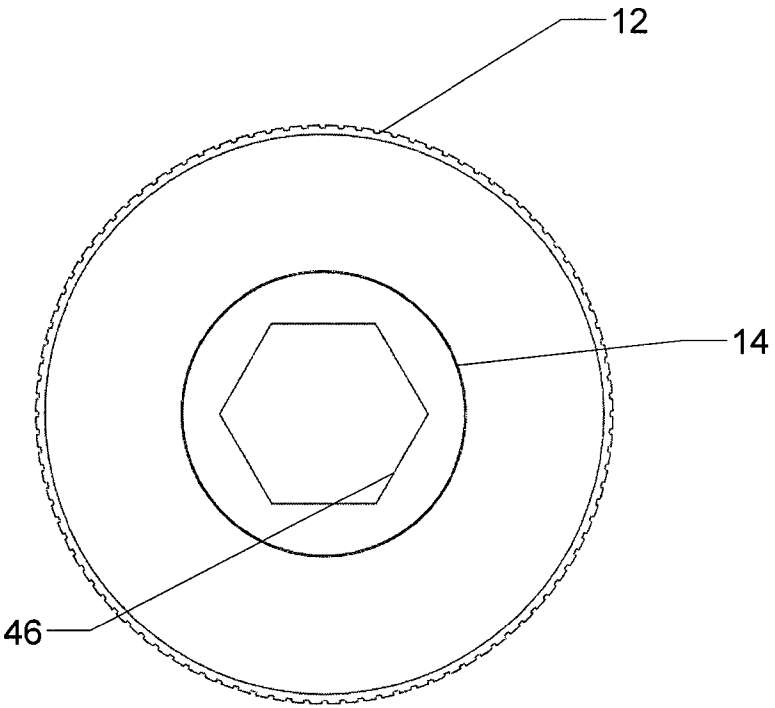
FIG. 8 is a bottom view of the knob guide barrel and knob.
Figure 9:
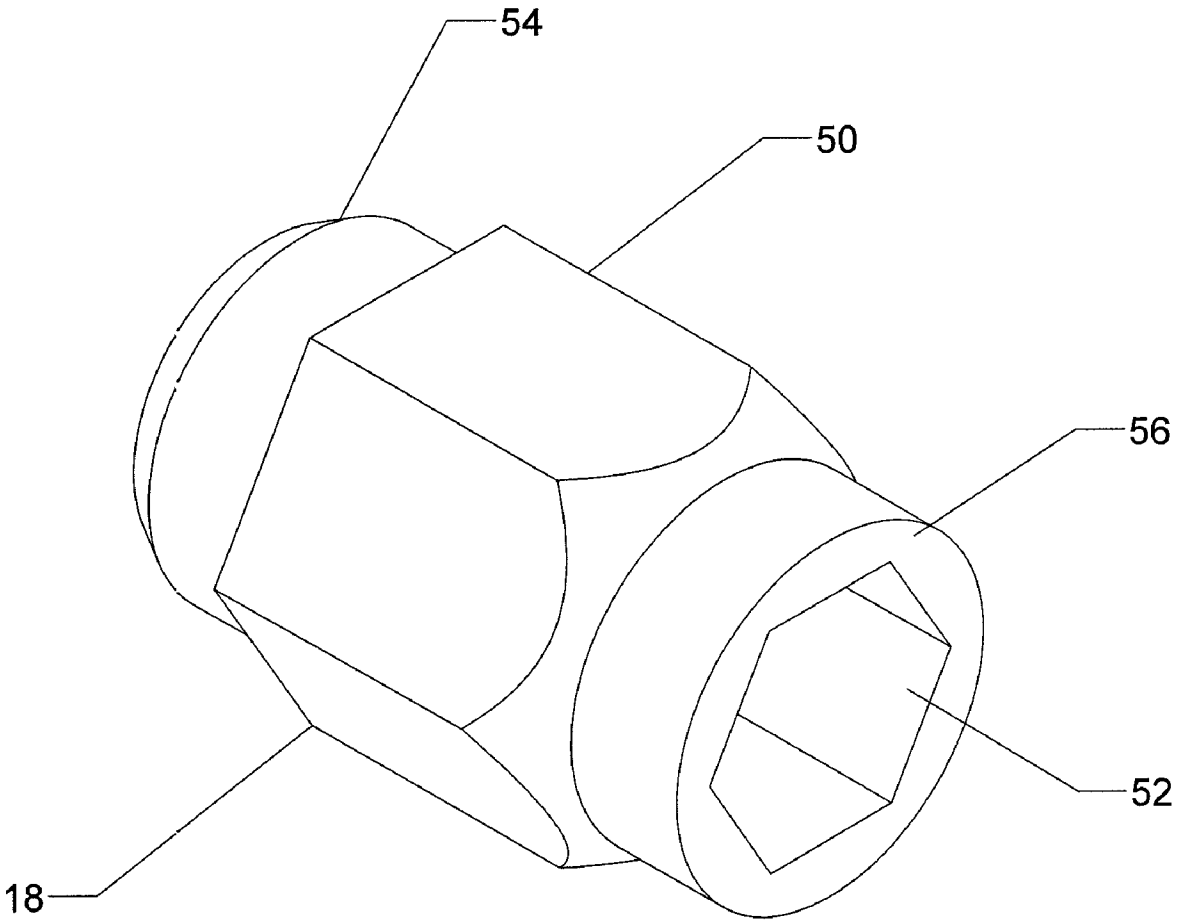
FIG. 9 is a perspective view of the adjustment driver.

FIG. 8 is a bottom view of the knob guide barrel (14) and knob (12). The hex shaped aperture (46) within the knob guide barrel (14) allows engagement of the adjustment driver (18) further depicted in FIG. 9. The adjustment driver (18) has an external hex shape surface (50). The hex surface (50) is insertable into receptacle form by the hex shaped aperture (46) of the knob guide barrel (14). In addition, the adjustment driver (18) includes an internal hex shaped aperture (52) which is operatively associated with the hex head of the level adjustment screw (20). The hex head (23) of the level adjustment screw (20) is allowed to move from a first end (54) to a second end (56) of the adjustment driver allowing the range of deployment for the footpad. Rotation of the knob guide barrel or use of the knob (12) is a direct drive to the adjustment driver which in turn allows the leveler adjustment screw (20) to be deployed when the threads (21) of the leveler adjustment screw (20) have rotated and engaged the pedestal cap (24) causing the aforementioned deployment. In the preferred embodiment, the second end (56) includes an engagement surface (58) that is placed against the wear resistant flat washer (22). It should be noted that while the hex shape for the contact surface is the preferred embodiment, the contact surface can be of any shape or design capable of driving the leveler adjustment screw. The actual shape is not necessary for operation of the invention as the shape could be three, four, five, six contact sides, or greater, wherein the purpose of both the first contact surface and first receptive contact surface, and the second contact surface and the second receptive contact surface is to allow engagement with a knob guide barrel as well as an internal surface (52) allows for engagement of the adjustment driver (18); and engagement of the adjustment driver (18) in relation to the leveler adjustment screw (20). It should also be noted that the knob guide barrel in the adjustment driver may be formed of a single piece of material; the separation of the pieces allows for ease of manufacturing only. While the preferred materials of constructing the top access leveler assembly are metal, the use of engineering plastic such as polycarbonate, polyamide, polyacetal, PBT and like materials are equally effective.

Figure 10:
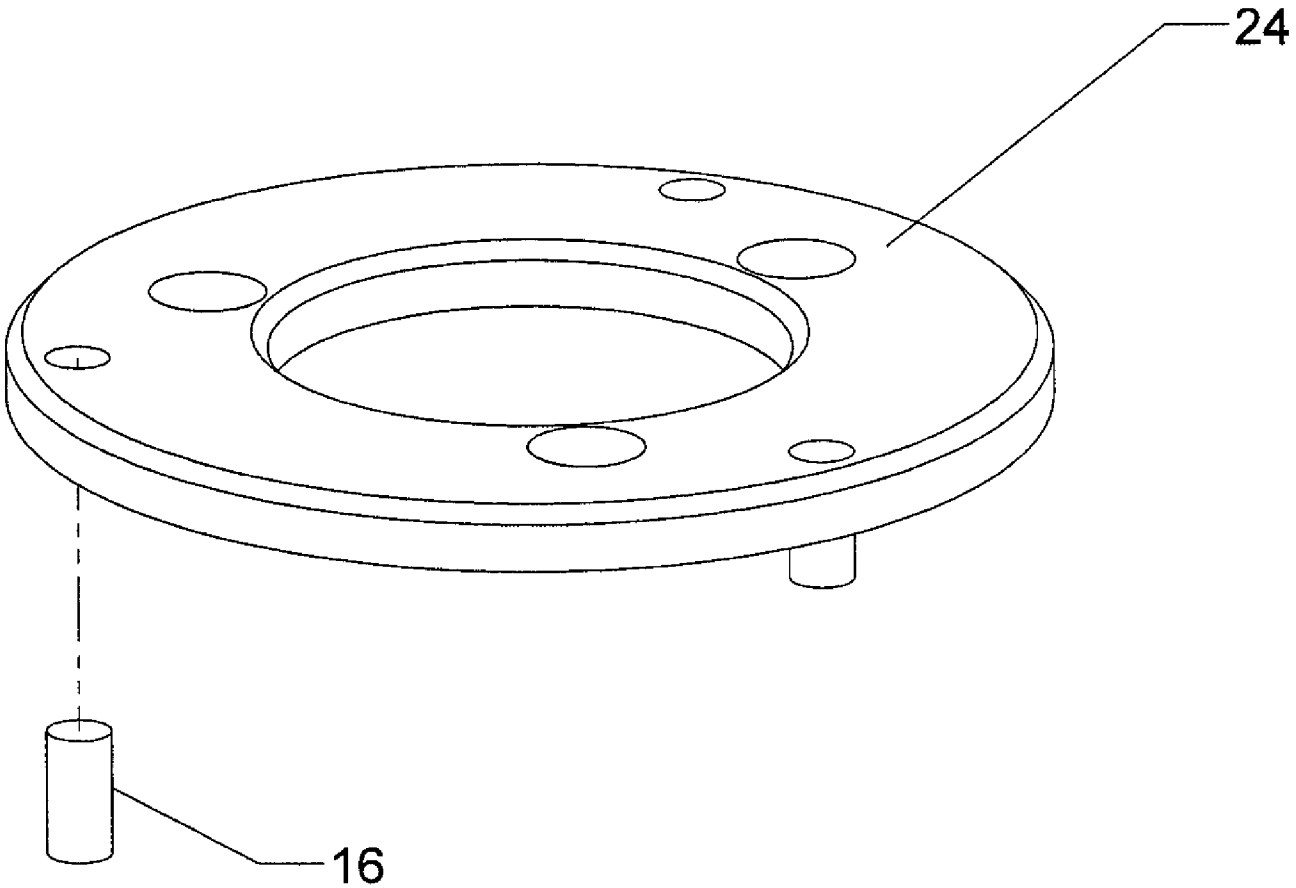
FIG. 10 is a perspective view of the pedestal cap.
Figure 11:
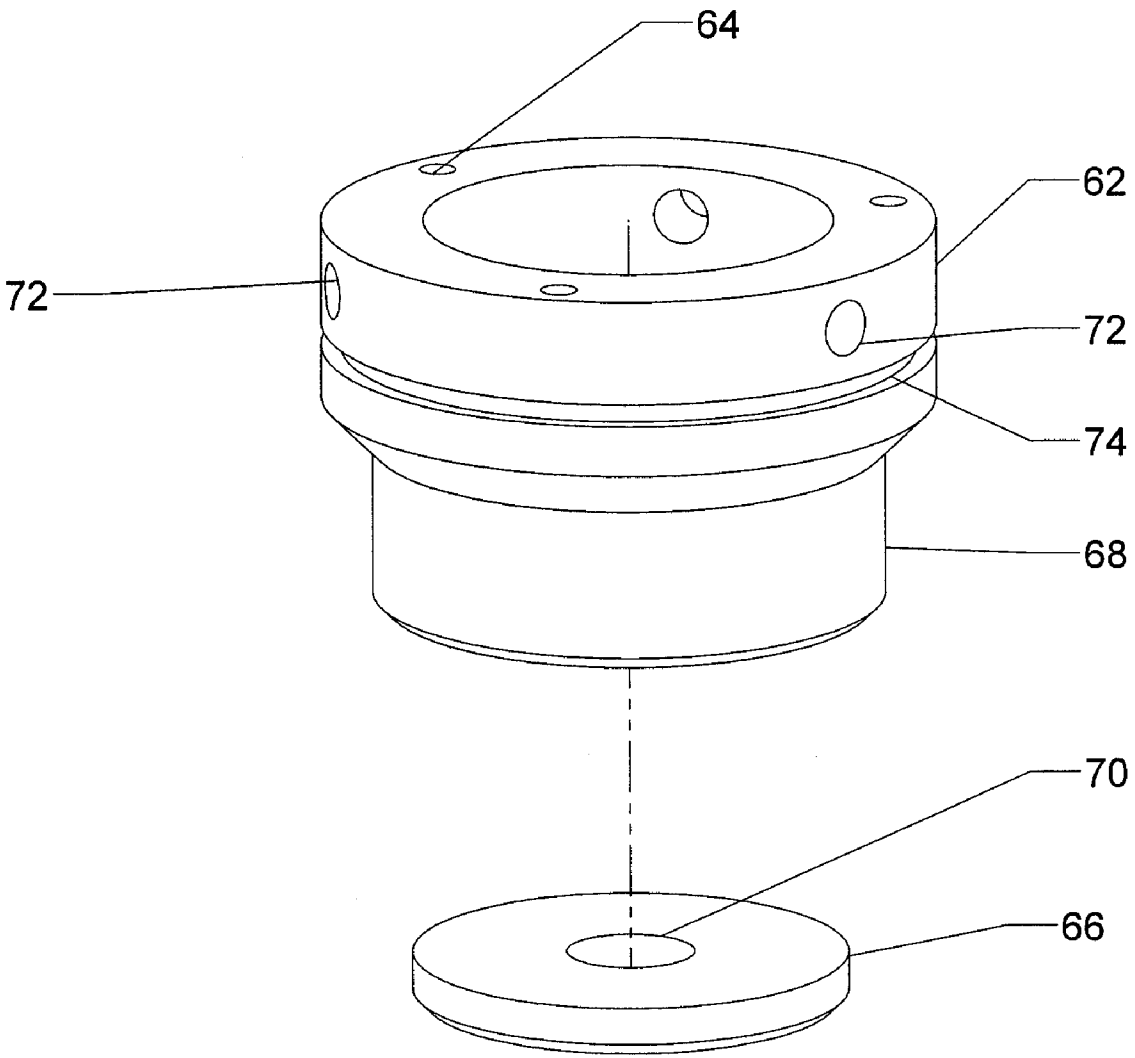
FIG. 11 is an exploded view of the pedestal guide barrel and pedestal barrel nut plug.
Figure 13:
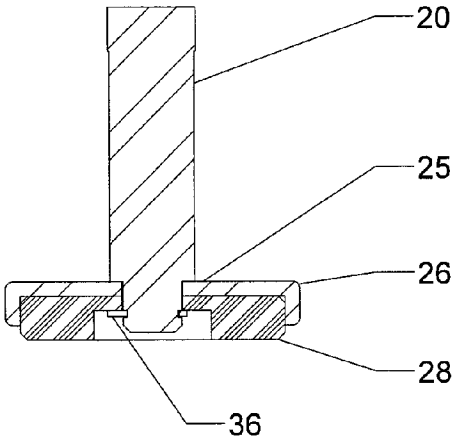
FIG. 13 is a cross-sectional view of the adjustable footpad.
Figure 12:
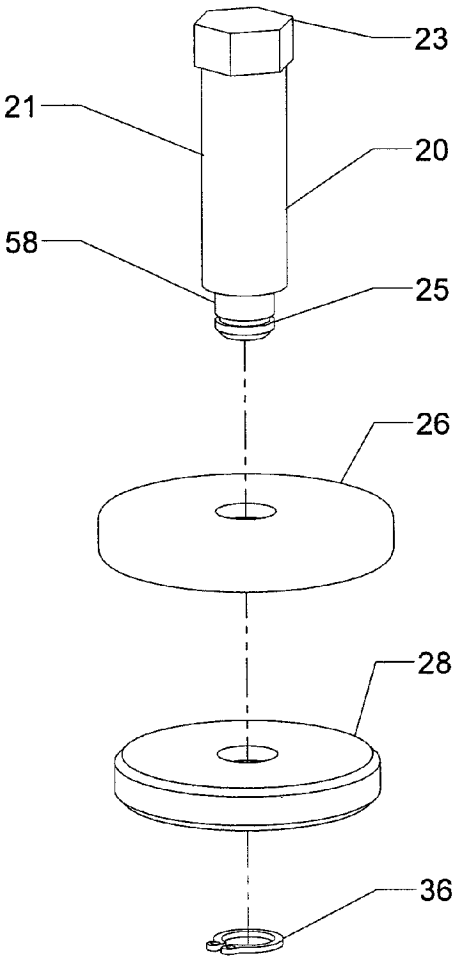
FIG. 12 is an exploded view of the adjustable footpad.
Figure 14:
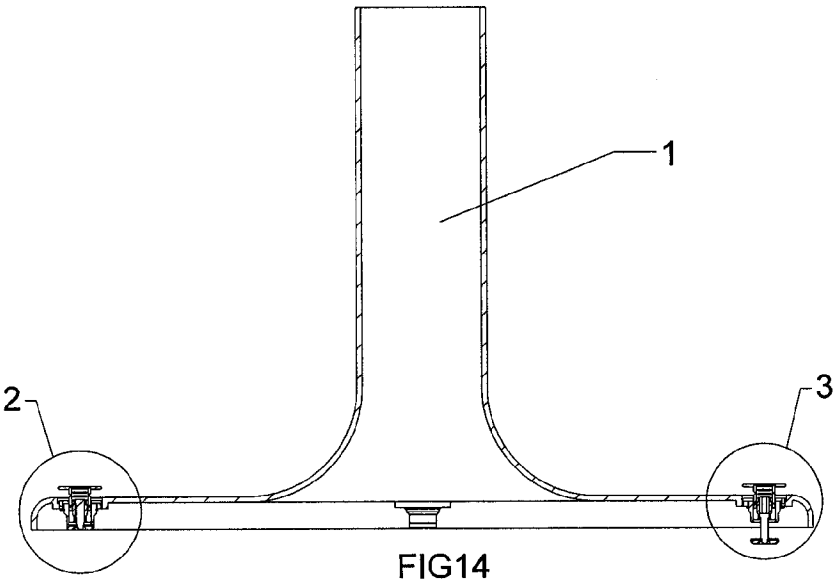
FIG. 14 is a cross section side view of a pedestal assembly having a raised knob guide barrel illustrating the footpad in a recessed position and in a deployed position.
Figure 16:
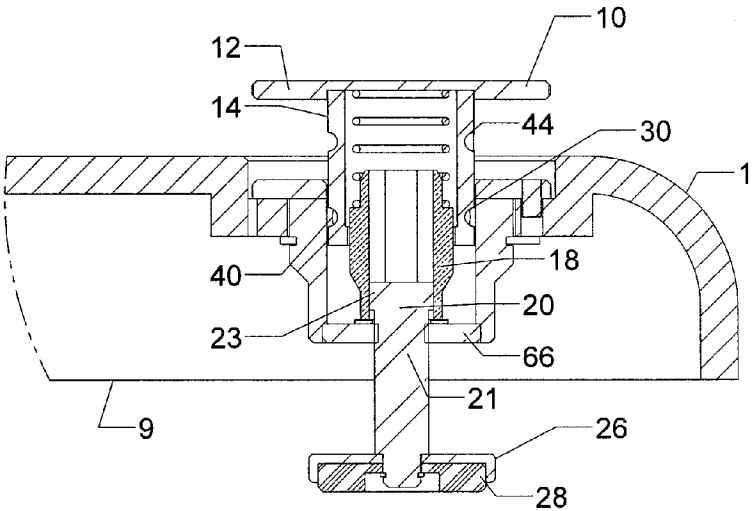
FIG. 16 is a partial detail of FIG. 14 illustrating the footpad in the deployed position.
Figure 15:
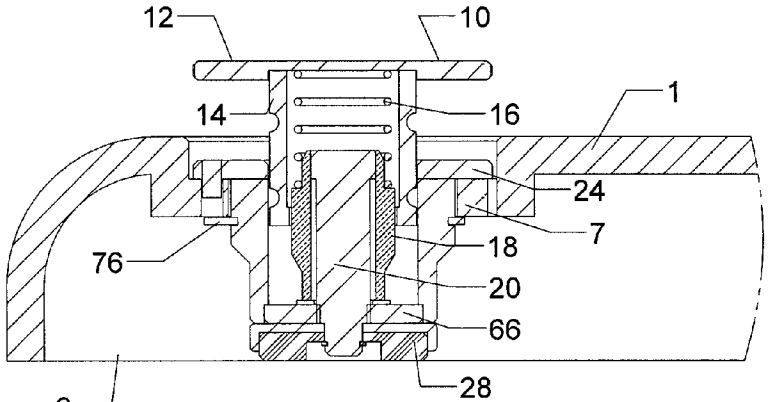
FIG. 15 is a partial detail of FIG. 14 illustrating the footpad in a recessed position.

Now referring to FIG. 10, the pedestal cap (24) is illustrated having alignment pins (60) for engagement with the pedestal guide barrel (16) shown in FIG. 11. The pedestal guide barrel (62) has a series of apertures (64) for receipt of alignment pins (60). A pedestal barrel nut plug (66) is secured to the lower end (68) of the pedestal guide barrel (62). The pedestal barrel nut plug (66) includes a centrally disposed aperture (70) that is sized to allow passage of the leveler adjustment screw threaded surface (31) that prevents passage of the hex head (23) of the leveler adjustment screw as well as the adjustment driver (18). The aforementioned ball (30) and set screw (32) are placed through aperture (72) for use in engaging the alignment channels (15) located on the knob guide barrel (14). Channel (74) is sized to engage retainer ring (76) which is placed within the leg of the apparatus to be stabilized. FIG. 12 depicts the leveler adjustment screw (20) depicted with a hex head (23) in an externally threaded surface (21), threads are not shown in this drawing for illustration purposes. The lower end (25) of leveler adjustment screw (20) is sized to receive the footpad cap (26) and footpad (28) all held in position by use of a stainless steel retainer ring (36). As further illustrated in FIG. 13, the leveler adjustment screw (20) depicts the footpad cap (26) with footpad (28) held in position along the lower end (25) by the retainer ring (36). For aesthetic purposes, the footpad cap may be of a material that is more aesthetically pleasing such as stainless steel or color match to the component to be stabilized while the footpad may be of a material more receptive to use on floors such as nylon, or could even be a felt material or any other variation that would allow firm stabilization of the accessory without marring the floor surface. Referring now to FIG. 14, set forth is a cross-sectional view showing a pedestal assembly (1) with detail (2) shown in FIG. 15 wherein the compression spring (16) maintains the knob guide barrel (14) in a raised position allowing rotation of the knob (12). The knob guide barrel engaging the adjustment driver (18) allows rotation of the leveler adjustment screw (20) for movement of the footpad (28) as needed. As shown in this embodiment, the pedestal cap (24) is over the pedestal base aperture (7) in use of the retainer ring (76) locks the top access leveler assembly (10) in position with the pedestal base (1). In this position, the knob is available for rotation so as to cause deployment of the footpad (28) by rotating the adjustment driver (18) causing rotation of the level adjustment screw (20) through the pedestal barrel nut plug (66). FIG. 14 also depicts detail (3) as set forth in FIG. 16 which again depicts the pedestal base (1) with the top access leveler assembly (10) shown with the knob (12) and knob guide barrel (14) in a raised position wherein the rotation of the knob (12) causing rotation of the adjustment driver (18), and in turn the leveler adjustment screw (20) through the length of the threaded surface (21) in operation with the pedestal barrel nut plug (66). The hex head (23) prevents further deployment of the leveler adjustment screw (20) wherein the footpad (28) and footpad cap (26) are now in a fully deployed position. It should be noted that the lower alignment grooves (40) are positioned for receipt of the ball (30) thereby allowing freedom of rotation of the knob in either a clockwise or counterclockwise position.

Figure 17:
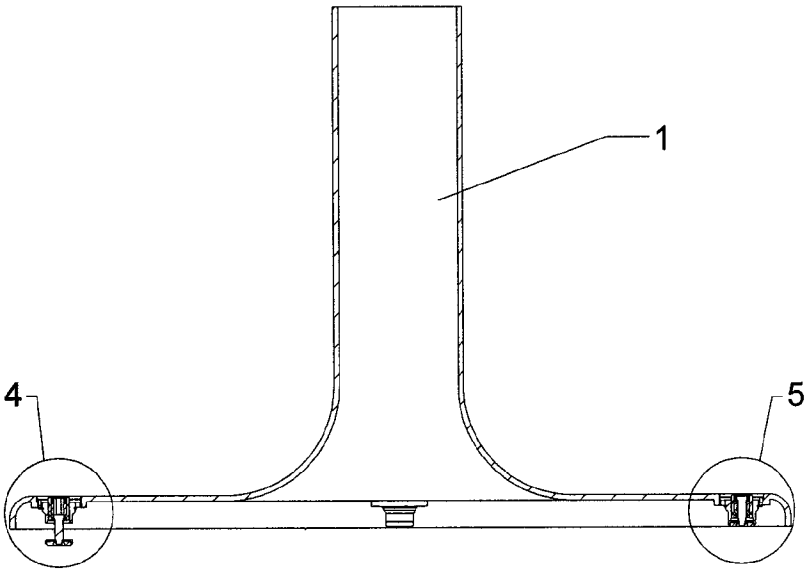
FIG. 17 is a cross-sectional side view of the pedestal assembly with the knob guide barrels in their recessed position.
Figure 19:
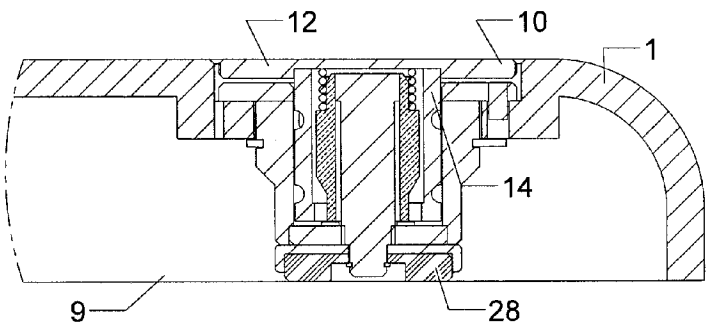
FIG. 19 is a partial detail of FIG. 17 illustrating the footpad in the recessed position.
Figure 18:
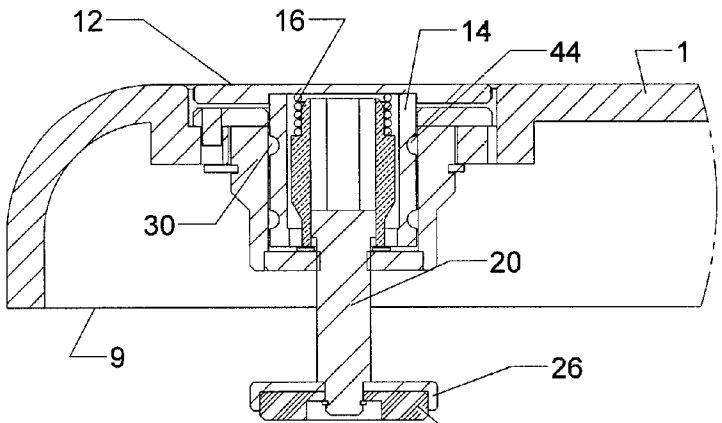
FIG. 18 is a partial detail of FIG. 16 illustrating the footpad in the deployed position.

FIG. 17 sets forth another illustration of the instant invention wherein a pedestal assembly (1) depicts detail (4) shown in cross-sectional view in FIG. 18. In this illustration, the leveler adjustment screw is in a fully deployed position with footpad (28) and footpad cap (26) well beneath the lower plain (9) of the pedestal base and the knob guide barrel (14) shown in a recessed position where upper alignment grooves (44) are now engaged with a ball (30) so as to maintain the knob (12) in a recessed position therein flush with the surface of the pedestal with spring (16) in a compressed position. The spring (16) further operates to engage the knob guide barrel (14) to prevent accidental movement. FIG. 17 depicts detail (5) as illustrated in FIG. 19 wherein the top access leveler assembly (10) includes both the knob guide barrel (14) and the footpad (28) in a recessed position wherein the top surface of the knob remains in the same plain as the upper surface of the pedestal assembly base. Similarly, the lower surface of the footpad (28) is in a recessed position and does not extend beyond the plain (9) of the lower level of the pedestal assembly.

It is to be understood that while certain forms of the invention are illustrated, it is not to be limited to the specific forms or arrangements herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are within the scope of the following claims.

What is claimed is:

1. An adjustable support for use in leveling an object comprising:

a pedestal guide barrel formed from a generally cylindrical member having an upper opening and a threaded lower opening, an external side wall and an internal side wall, said external side wall securable to a base of an object in need of leveling;

a leveling adjustment screw having an upper end with a first contact surface, a lower end, and a threaded shaft portion threadably engaged in said threaded bore such that the threaded shaft portion can be extended from a recessed position to an extended position;

an adjustment driver positionable within said cavity of said guide barrel, said adjustment driver having an engagement bore having a first receptacle contact surface for slidable receipt of said first contact surface of said leveling adjustment screw, said adjustment driver having an outer surface forming a second contact surface;

a knob guide barrel positionable over said adjustment driver and within the cavity of said pedestal guide barrel having a second receptacle contact surface formed along an internal chamber for slidable receipt of said adjustment driver second contact surface and an outer wall constructed and arranged to extend above said adjustment driver for rotation thereof and retract into the cavity of said pedestal guide barrel when not in use.

2. The adjustable support according to claim 1 wherein said first contact surface and said first receptacle contact surface are hex shaped.

3. The adjustable support according to claim 1 wherein said second contact surface and said second receptacle contact surface are hex shaped.

4. The adjustable support according to claim 1 wherein said knob guide barrel including a knob having an upper surface that is flush with the upper surface of the base of said object in need of leveling when not in use, and extends above the upper surface of the base of said object in need of leveling to allow ease of rotation when in use.

5. The adjustable support according to claim 4 wherein said knob guide barrel includes a compression spring to bias said knob in the position above the upper surface.

6. The adjustable support according to claim 1 wherein said knob guide barrel includes alignment channels to allow positioning of said knob flush with the upper surface of the base of said object in need of leveling when not in use and to allow extending of the knob above the upper surface of the base of said object in need of leveling to permit ease of rotation when in use.

7. The adjustable support according to claim 1 wherein a foot pad constructed from non-marring material is positioned along said lower end of said leveling adjustment.

8. The adjustable support according to claim 7 including a covering positioned over an upper surface of said foot pad.

9. The adjustable support according to claim 1 wherein said threaded lower opening of said pedestal guide barrel is sized to permit said threaded shaft portion of said leveling adjustment screw to extend therethrough.

10. The adjustable support according to claim 1 wherein said object is a table.

11. The adjustable support according to claim 10 wherein said table includes a pedestal shaped base.

12. An adjustable support for use in leveling a table having a pedestal base, said adjustable support comprising:

a pedestal guide barrel formed from a generally cylindrical member having an upper opening and a threaded lower opening, an external side wall and an internal side wall, said external side wall securable to the pedestal base;

a leveling adjustment screw having an upper end with a first contact surface, a lower end, and a threaded shaft portion threadably engaged in said threaded bore such that the threaded shaft portion can be extended from a recessed position to an extended position, said lower end having a foot pad coupled thereto;

an adjustment driver positionable within said cavity of said guide barrel, said adjustment driver having an engagement bore having a first receptacle contact surface for slidable receipt of said first contact surface of said leveling adjustment screw, said adjustment driver having an outer surface forming a second contact surface;

a knob guide barrel positionable over said adjustment driver and within the cavity of said pedestal guide barrel having a second receptacle contact surface formed along an internal chamber for slidable receipt of said adjustment driver second contact surface and an outer wall having alignment channels to allow said knob guide barrel to be extended above said adjustment driver for rotation thereof and permit retraction of said knob guide barrel into the cavity of said pedestal guide barrel when not in use, said knob guide barrel including a knob having an upper surface that is flush with an upper surface of the pedestal base when not in use and extends above the upper surface of the pedestal base to allow ease of rotation when in use.

13. The adjustable support according to claim 12 wherein said first contact surface and said first receptacle contact surface are hex shaped.

14. The adjustable support according to claim 12 wherein said second contact surface and said second receptacle contact surface are hex shaped.

15. The adjustable support according to claim 12 wherein said knob guide barrel includes a compression spring to bias said knob in the position above the upper surface.

16. The adjustable support according to claim 12 wherein said foot pad is constructed from non-marring material.

17. The adjustable support according to claim 16 including a covering positioned over an upper surface of said foot pad.

* * * * *